US009142931B2

(12) United States Patent
Springston, II

(10) Patent No.: US 9,142,931 B2
(45) Date of Patent: Sep. 22, 2015

(54) CRIMP TOOL WITH CAM ACTUATED CRIMP JAW

(75) Inventor: Eric D. Springston, II, Hershey, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 584 days.

(21) Appl. No.: 12/708,238

(22) Filed: Feb. 18, 2010

(65) Prior Publication Data

US 2011/0197647 A1 Aug. 18, 2011

(51) Int. Cl.

| | |
|---|---|
| ***B25B 7/12*** | (2006.01) |
| ***H01R 43/042*** | (2006.01) |
| *H01R 43/045* | (2006.01) |
| *B25B 27/14* | (2006.01) |

(52) U.S. Cl.

CPC ..... *H01R 43/042* (2013.01); *B25B 27/146* (2013.01); *H01R 43/045* (2013.01)

(58) Field of Classification Search

CPC .... H01R 43/042; H01R 43/048; H01R 43/22; H01R 43/05; H01R 43/04; B25B 27/146; B25B 7/02; B25B 7/12; B25B 7/00; B25B 7/10; B21B 7/02; B21D 39/021; B30B 1/14

USPC ..... 72/409.01, 409.07, 409.08, 409.09, 72/409.1, 409.19, 450, 451, 409.12, 452.8, 72/409.14; 29/282, 283.5, 753, 861, 751, 29/758, 564.4, 566.2, 863; 81/361, 362, 81/385

See application file for complete search history.

(56) References Cited

U.S. PATENT DOCUMENTS

| | | | | | |
|---|---|---|---|---|---|
| 2,616,316 | A | * | 11/1952 | Dupre | 72/409.1 |
| 3,101,017 | A | * | 8/1963 | Buchalter et al. | 72/409.01 |
| 3,324,702 | A | * | 6/1967 | Malkin | 72/409.01 |
| 3,406,558 | A | * | 10/1968 | Tillmann et al. | 72/416 |
| 4,266,419 | A | * | 5/1981 | Grundfest | 72/452.4 |
| 4,433,569 | A | * | 2/1984 | Santinelli | 72/409.01 |
| 5,074,142 | A | | 12/1991 | Heskey et al. | |
| 5,094,097 | A | * | 3/1992 | Tooth et al. | 72/409.01 |
| 5,267,464 | A | | 12/1993 | Cleland | |
| 6,026,671 | A | * | 2/2000 | Battenfeld | 72/409.12 |
| 6,279,432 | B1 | | 8/2001 | Osborn et al. | |
| 6,612,147 | B2 | * | 9/2003 | Beetz et al. | 72/409.16 |
| 6,877,228 | B2 | * | 4/2005 | Beetz et al. | 30/134 |
| 7,155,954 | B2 | * | 1/2007 | Battenfeld | 72/409.07 |
| 7,503,201 | B2 | | 3/2009 | Cleland et al. | |
| 2006/0213248 | A1 | | 9/2006 | Cleland et al. | |

* cited by examiner

*Primary Examiner* — Shelley Self
*Assistant Examiner* — Lawrence Averick

(57) ABSTRACT

A crimp tool is provided for crimping a workpiece. The crimp tool includes a crimp head having a crimp jaw. The crimp jaw includes opposing upper and lower jaw members arranged along a crimp axis. The lower jaw member is movable along the crimp axis relative to the upper jaw member. A handle is mounted to the crimp head. The handle includes a frame and a lever rotatably mounted on the frame for rotation relative to the frame between an open position and a closed position. A cam is operatively connected between the lever of the handle and the lower jaw member of the crimp head. The cam is configured to translate rotational movement of the lever relative to the frame into movement of the lower jaw member along the crimp axis.

11 Claims, 12 Drawing Sheets

CRIMP TOOL WITH CAM ACTUATED CRIMP JAW

BACKGROUND OF THE INVENTION

The subject matter described and/or illustrated herein relates generally to crimp tools, and more particularly, to hand-operated crimp tools.

Crimp tools are widely used for crimping a wide variety of workpieces. For example, crimp tools are used to crimp electrical terminals onto electrical conductors. Crimp tools include a crimp jaw having opposing jaw members for crimping the workpiece. One or both of the jaw members is driven toward the other to close the crimp jaw against the workpiece. Some crimp tools are manually operated using a user's hands. Such hand-operated crimp tools typically include a handle having a pair of arms that are squeezed together to close the crimp jaw of the tool. A user must exert a predetermined amount of force on the arms of the handle to squeeze the arms together; such force being commonly referred to as a "handle force". As the arms of the handle are squeezed together, crimp tools often begin with a relatively low handle force when the arms are rather spread apart and build to a higher peak handle force as the arms come together to complete the crimp. In some circumstances, it may be desirable that a hand-operated crimp tool be capable of being operated using only a single hand of the user. For example, the user may need the other hand to perform other tasks and/or hold other items. Moreover, two-handed tools may be difficult to use in confined spaces.

The peak handle force of at least some known hand-operated crimp tools is undesirably high. For example, some peak handle forces require that a user use two hands to squeeze the arms of the handle together. Moreover, and for example, too high of a peak handle force can cause the user discomfort and/or injury. Hand injuries that may be caused by too high of a peak handle force include, but are not limited to, fatigue, stress-related injuries, repetitive motion injuries, joint and musculature injuries, and/or the like. One solution for reducing the peak handle force of crimp tools is to lengthen the arms of the handle and thereby provide a longer lever arm. But, the longer handle arms result in a larger and/or bulkier crimp tool, which may be difficult to use in confined spaces, carry around, and/or stow away. Moreover, the increased distance between the ends of the longer arms of the handle may make it difficult or impossible to use the crimp tool with only a single hand.

There is a need for providing a crimp tool with a lower peak handle force while maintaining or reducing the length of the arms of a handle of the crimp tool.

BRIEF DESCRIPTION OF THE INVENTION

In one embodiment, a crimp tool is provided for crimping a workpiece. The crimp tool includes a crimp head having a crimp jaw. The crimp jaw includes opposing upper and lower jaw members arranged along a crimp axis. The lower jaw member is movable along the crimp axis relative to the upper jaw member. A handle is mounted to the crimp head. The handle includes a frame and a lever rotatably mounted on the frame for rotation relative to the frame between an open position and a closed position. A cam is operatively connected between the lever of the handle and the lower jaw member of the crimp head. The cam is configured to translate rotational movement of the lever relative to the frame into movement of the lower jaw member along the crimp axis.

In another embodiment, a crimp tool for crimping a workpiece includes a crimp head having a crimp jaw. The crimp jaw includes opposing jaw members. At least one of the jaw members is movable toward and away from the other jaw member for crimping an object therebetween. A handle is mounted to the crimp head. The handle includes a frame and a lever rotatably mounted on the frame for rotation relative to the frame between an open position and a closed position. A cam is rotatably mounted on the frame of the handle for rotation relative to the frame. The cam is operatively connected between the lever of the handle and the at least one jaw member of the crimp head. The cam is configured to translate movement of the lever relative to the frame into movement of the at least one jaw member. The cam is configured to rotate in a clockwise direction and a counter-clockwise direction relative to the frame.

DETAILED DESCRIPTION OF THE INVENTION

Figure 1:
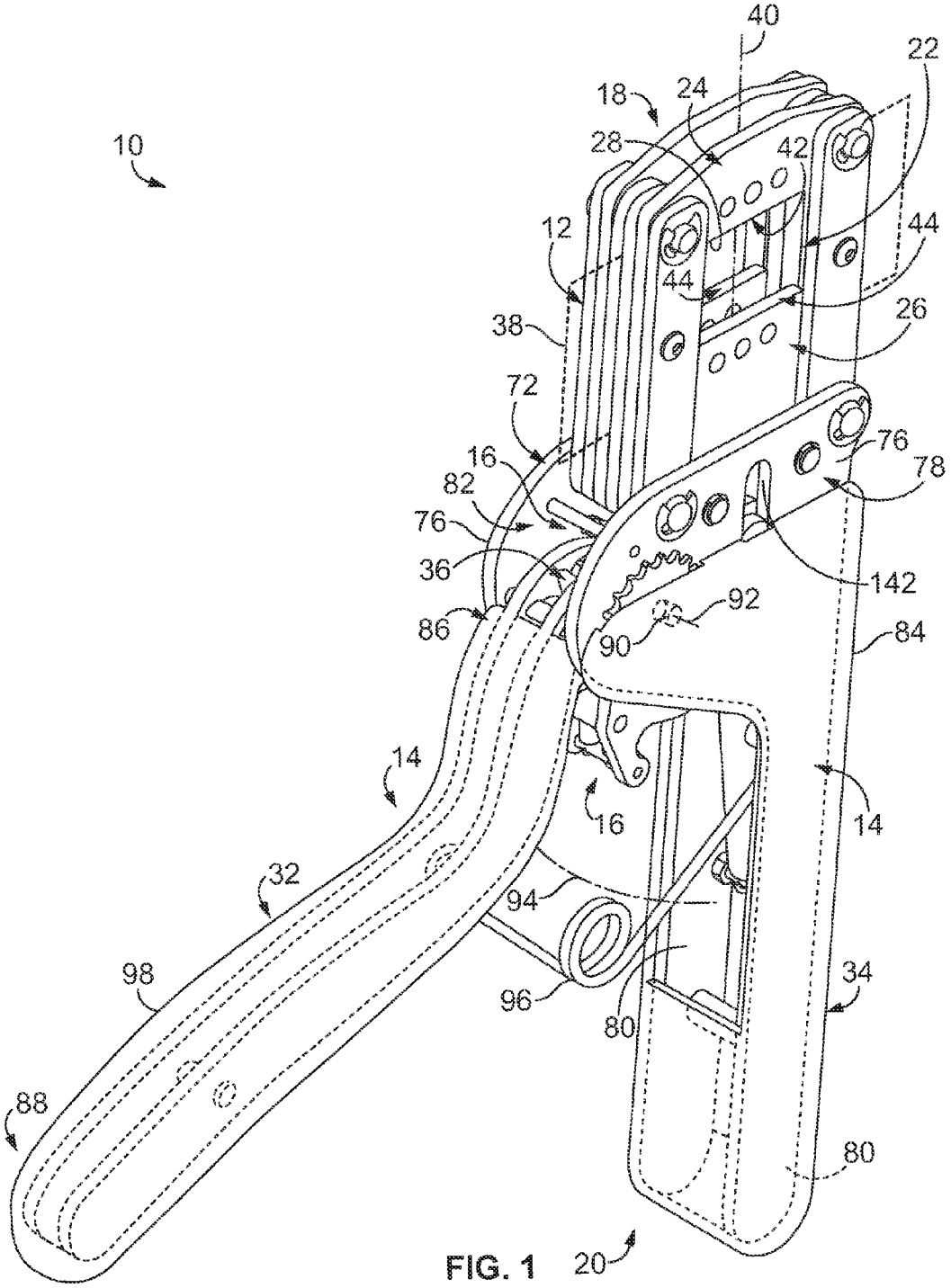
FIG. 1 is a perspective view of an exemplary embodiment of a crimp tool.

FIG. 1 is a perspective view of an exemplary embodiment of a crimp tool 10. The crimp tool 10 includes a crimp head 12, a handle 14 mounted to the crimp head 12, and a toggle mechanism 16. The crimp tool 10 extends a length from an end 18 of the crimp head 12 to an end 20 of the handle 14. The crimp head 12 includes a crimp jaw 22 having a pair of opposing jaw members 24 and 26 that define an opening 28 therebetween. The opening 28 defines a crimp zone of the tool 10. The handle 14 includes a lever 32 and an arm 34. The toggle mechanism 16 is operatively connected between the handle 14 and the crimp jaw 22. In operation of the crimp tool 10, one or more workpieces (not shown) is positioned in the crimp zone between the jaw members 24 and 26. The lever 32 and the arm 34 are squeezed together, for example using a single or both hands of a user. The toggle mechanism 16 translates the relative motion between the lever 32 and the arm 34 to the crimp jaw 22 to close the jaw members 24 and 26 toward each other and crimp the workpiece therebetween. As will be described in more detail below, the toggle mechanism 16 includes a cam 36.

Referring now to the crimp head 12, a crimp head plane 38 extends therethrough. As can be seen in FIG. 1, the crimp head plane 38 extends through the crimp head 12 generally parallel to the length of the tool 10 and parallel to a width of the crimp head 12. The jaw members 24 and 26 are arranged along a crimp axis 40 that lies within and is parallel to the crimp head plane 38, which extends through the crimp zone. The jaw members 24 and 26 oppose each other along the crimp axis 40. Specifically, the jaw members 24 and 26 are positioned along the crimp axis 40 such that respective pressing ends 42 and 44 of the jaw members 24 and 26 face each other. In the exemplary embodiment, the jaw member 26 is movable along the crimp axis 40 toward and away from the jaw member 24, which remains stationary relative to the crimp axis 40 as the jaw member 26 moves therealong. In other words, the exemplary crimp jaw 22 includes a stationary jaw member and a movable jaw member. Alternatively, in addition or alternative to the jaw member 26, the jaw member 24 is configured to move along the crimp axis 40. In other words, in some alternative embodiments, the crimp jaw 22 includes two movable jaw members. The jaw member 24 may be referred to herein as an "upper jaw member", while the jaw member 26 may be referred to herein as a "lower jaw member".

The exemplary crimp tool 10 is what is commonly referred to as a "straight action" crimp tool. Specifically, the relative movement between the jaw members 24 and 26 is linear, or straight, along the crimp axis 40, which as can be seen in the Figures extends along a linear path. Alternatively, the crimp tool 10 is what is commonly referred to as a "scissor-action" tool, wherein the relative movement between two opposing jaw members 24 is curved along a curved axis.

Figure 2:
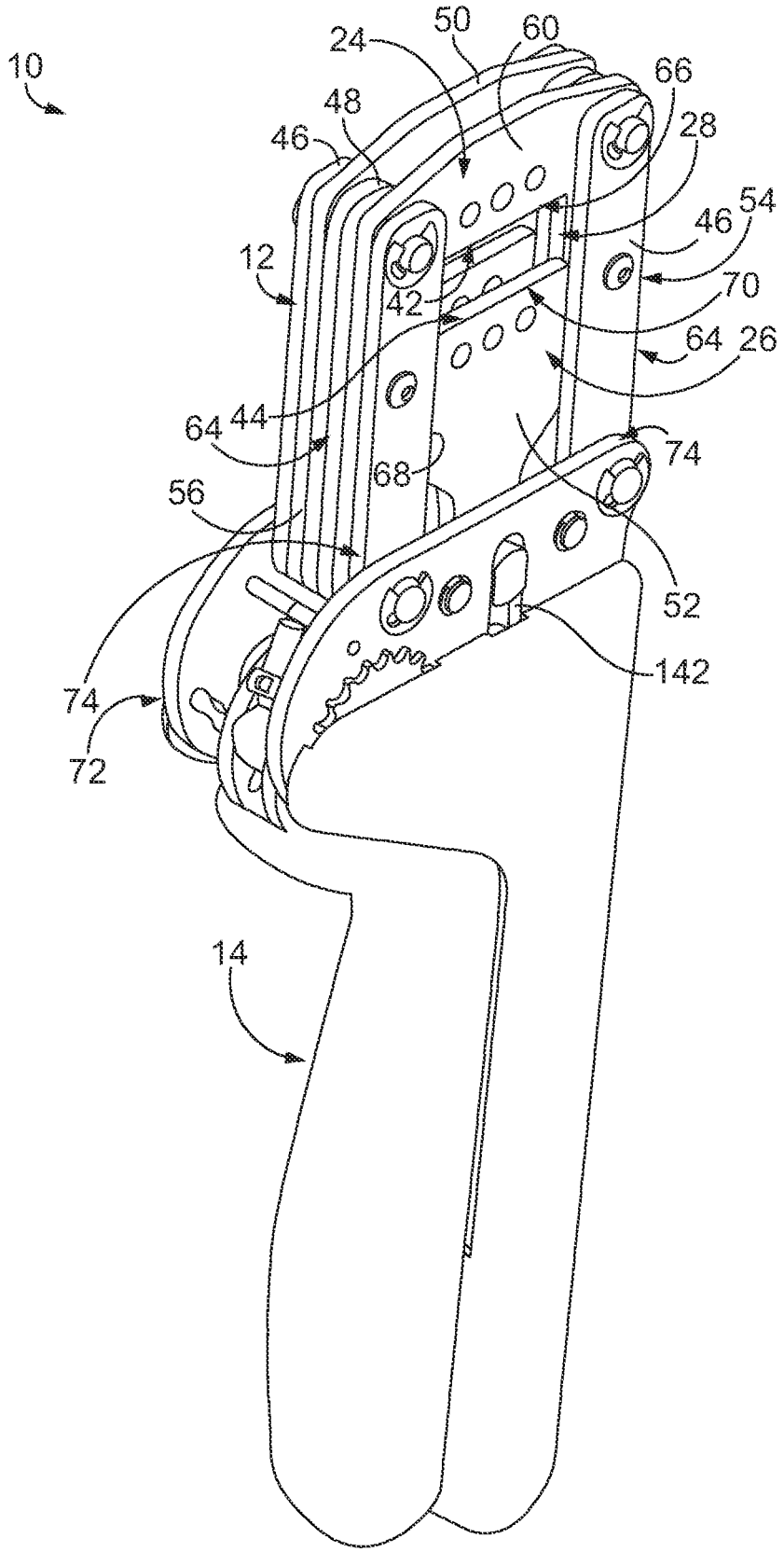
FIG. 2 is another perspective view of the crimp tool shown in FIG. 1 illustrating an exemplary embodiment of a lever of the crimp tool in a closed position.

FIG. 2 is another perspective view of the crimp tool 10. In the exemplary embodiment, the crimp head 12 includes the jaw members 24 and 26, a plurality of frame plates 46, and a plurality of spacer plates 48. The jaw member 24 is constructed from two jaw plates 50, and the jaw member 26 is similarly constructed from two jaw plates 52. The plates 46, 48, and 50 are stacked together to define a frame 54 of the crimp head 12. Specifically, each jaw plate 50 includes a "U" shape defined by a pair of legs 56 that are interconnected at ends thereof by a bridge segment 60. The spacer plates 48 are stacked together with the jaw plates 50 such that the spacer plates 48 are positioned between the legs 56 of the jaw plates 50. The jaw plates 50 are thereby spaced apart from each other by the spacer plates 48. The frame plates 46 are stacked together with the stack of jaw plates 50 and spacer plates 48 such that the legs 56 of the jaw plates 50 are sandwiched between the frame plates 46. The stack of plates 46, 48, and 50 are fastened together to define the "U" shaped frame 54 of the crimp head 12.

The crimp head frame 54 includes opposite legs 64 defined by the plates 46 and 48 and the legs 56 of the jaw plates 50. The bridge segments 60 of the jaw plates 50 extend between the legs 64 and define the jaw member 24. Side portions 66 of the bridge segments 60 define the pressing end 42 of the jaw member 24. A channel 68 is defined between the legs 64. The jaw plates 52 are held within the channel 68 and define the jaw member 26. Side portions 70 of the jaw plates 52 define the pressing end 44 of the jaw member 24. The side portions 70 of the jaw plates 52 oppose the side portions 66 of the jaw plates 50 to define the opening 28 therebetween. The jaw plates 52 are movable within the channel 68 along the crimp axis 40 (FIGS. 1, 3, and 5-9) toward and away from the bridge segments 60 of the jaw plates 50. The crimp head frame 54 is mounted to a frame 72 of the handle 14. Specifically, the legs 64 of the crimp head frame 54 include ends 74 that are mounted to the frame 72 of the handle 14.

Optionally, one or more dies (not shown) may be coupled to, or integrally formed into, the pressing end 42 of the jaw member 24 and/or the pressing end 44 of the jaw member 26. For example, the pressing end 42 and/or 44 may include one or more dies that have a complementary size and/or shape relative to the workpiece before crimping and/or relative to a predetermined crimped size and/or shape of the workpiece. Alternatively, the pressing ends 42 and 44 of the jaw members 24 and 26, respectively, directly engage the workpiece during crimping of the workpiece. The workpiece may be any type of workpiece having any structure (e.g., size, shape, and/or material) that is desired to be crimped, such as, but not limited to, an electrical terminal (not shown) that is to be crimped to an electrical conductor (not shown).

Referring again to FIG. 1, the handle 14 includes the lever 32 and the frame 72, which includes the arm 34. In the exemplary embodiment, the frame 72 is defined by two frame members 76. Each frame member 76 includes a base 78 and an arm segment 80 extending outwardly from the base 78. The frame members 76 are fastened together in a spaced apart relationship to define a compartment 82 between the bases 78 within which the toggle mechanism 16 is held. The arm segments 80 of the frame members 76 define the arm 34 of the handle 14. An optional cover and/or grip 84 may cover some or all of the frame 72, for example to enable a user to more easily grasp, hold, and/or manipulate the crimp tool 10.

Figure 7:
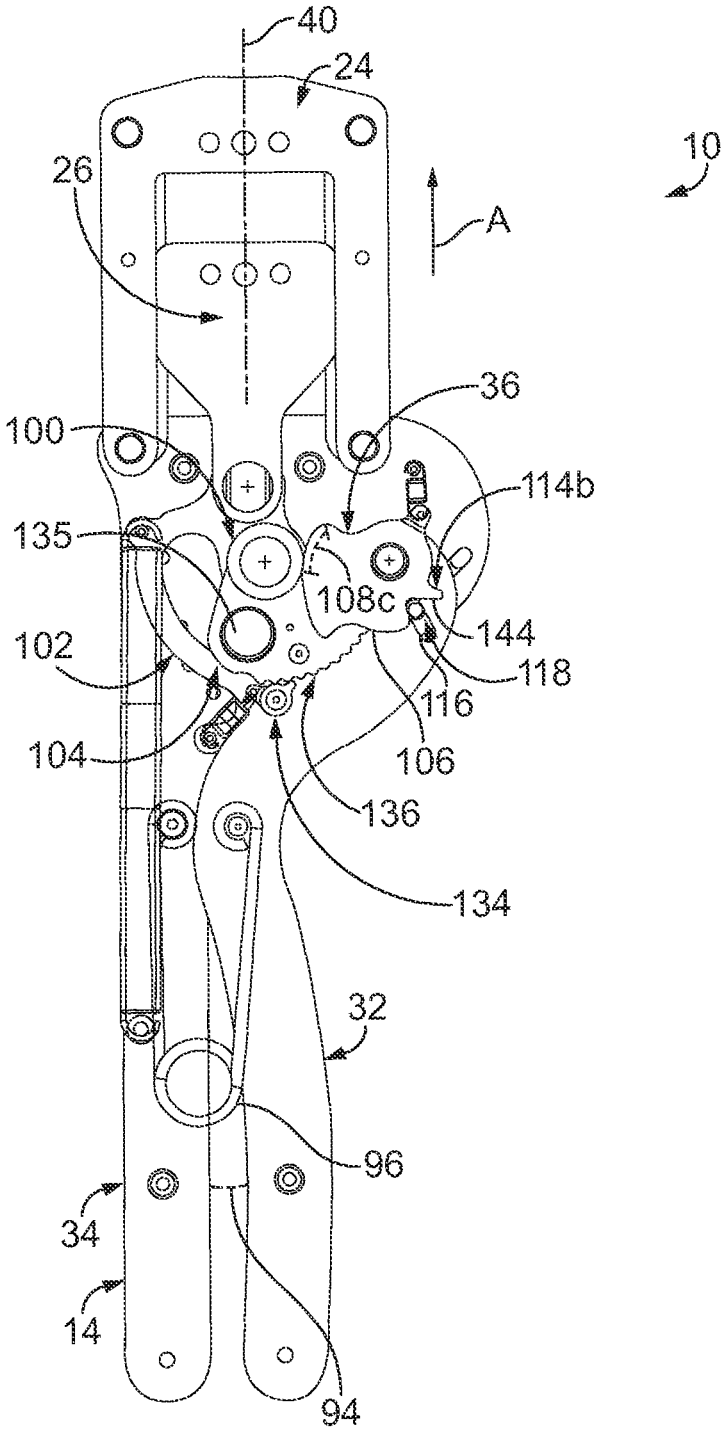
Figure 8:
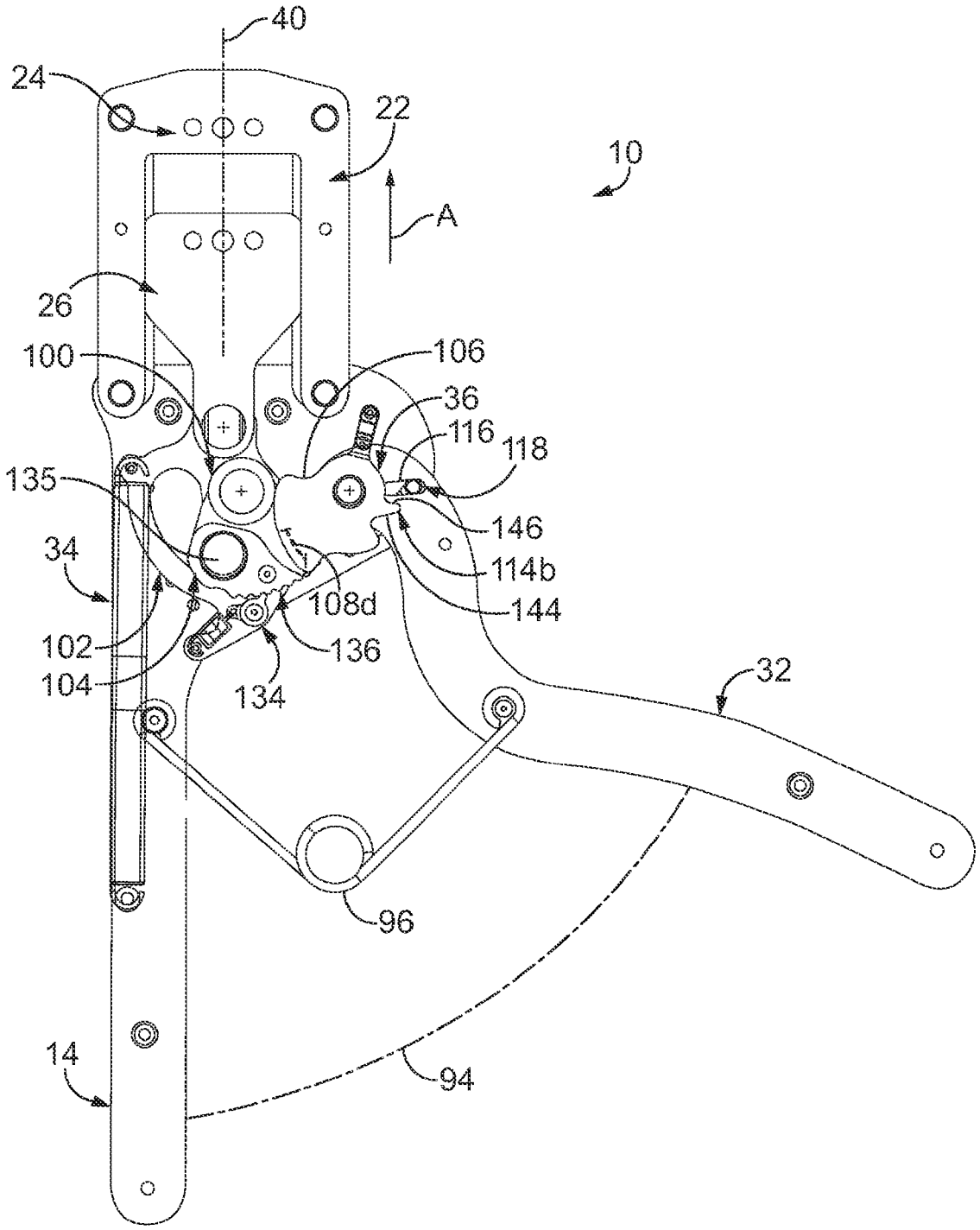
Figure 9:
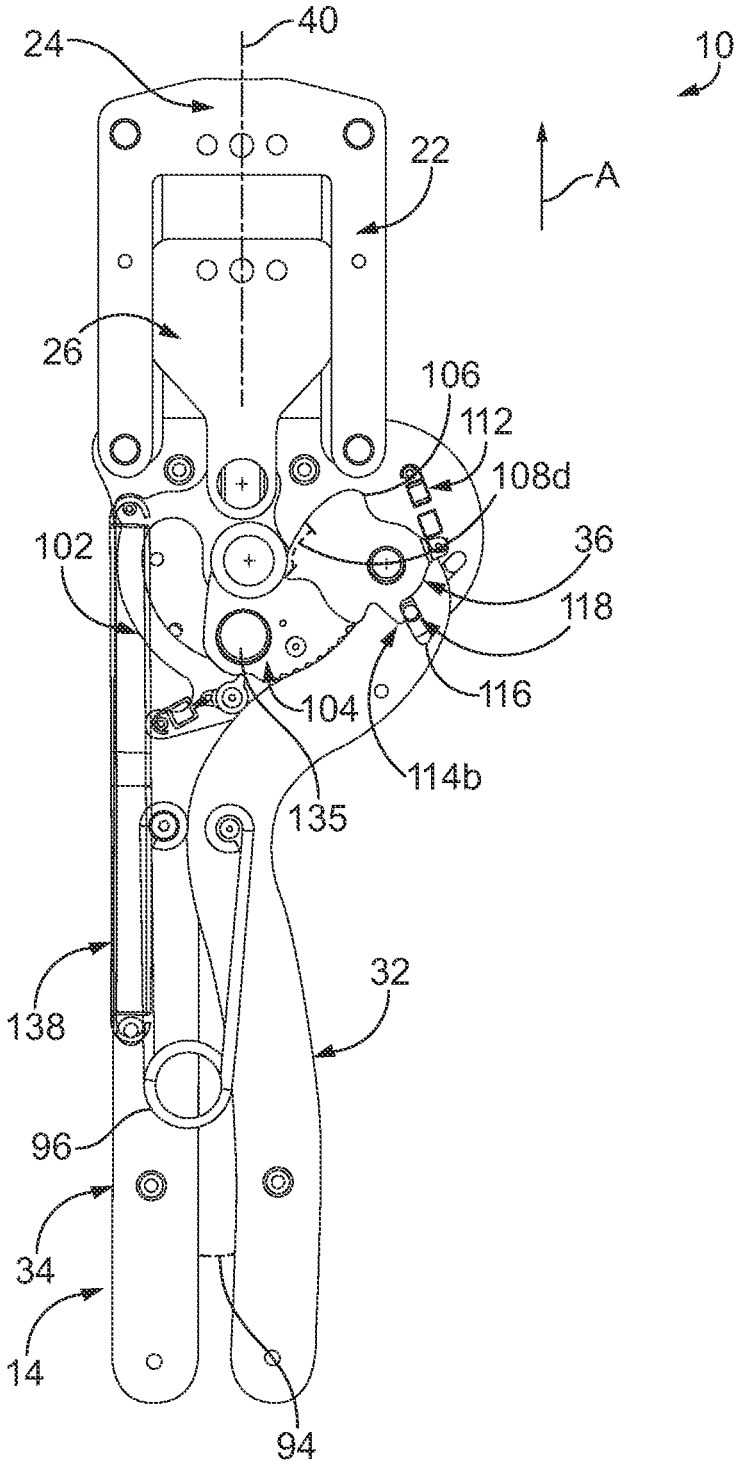

The lever 32 extends a length from a mounting end 86 to a free end 88. The lever 32 is rotatably mounted to the frame 72. Specifically, the mounting end 86 of the lever 32 is mounted to the frame 72 using a pivot bearing 90 that enables the lever 32 to rotate relative to the frame 72 about an axis of rotation 92 centered about the pivot bearing 90. The lever 32 is rotatable relative to the frame 72 along an arc 94 between an open position (FIGS. 1, 3, 5, and 8) and a closed position (FIGS. 2, 7, and 9). The open position of the lever 32 corresponds to an open position of the crimp jaw 22 wherein the jaw members 24 and 26 are the farthest apart from each other. The closed position of the lever 32 corresponds to a closed, or crimped, position of the crimp jaw 22 wherein the jaw members 24 are closest to each other. The lever 32 is closed relative to the arm 34 along the are 94 to move the jaw member 26 along the crimp axis 40 in a direction toward the jaw member 26.

In the exemplary embodiment, the arm 34 of the handle 14 is stationary relative to the crimp head 12, while the lever 32 is movable relative to the crimp head 12 along the arc 94. In addition or alternative to the lever 32, the arm 34 is optionally movable relative to the crimp head 12. In the exemplary embodiment, the pivot bearing 90 is a solid rod that extends through holes within the frame 72 and lever 32 to interconnect the lever 32 to the frame 72. The pivot bearing 90 is sized and shaped relative to holes within the frame 72 and the lever 32 such that the lever 32 can rotate, or pivot, about the pivot bearing 90 relative to the frame 72. In addition or alternative to the pivot bearing 90 and/or the holes of the frame 72 and/or the lever 32, the lever 32 may be rotatably mounted on the frame 72 using any other structure, means, arrangement, configuration, type of bearing, and/or the like. For example, the lever 32 may be rotatably mounted on the frame 72 using a flexural bearing, a roller bearing, a ball bearing, and/or the like.

An optional spring 96 is connected between the lever 32 and the arm 34 for biasing the lever to the open position. Optionally, a cover and/or grip 98 may cover some or all of the lever 32, for example to enable a user to more easily grasp, hold, and/or manipulate the crimp tool 10.

Figure 3:
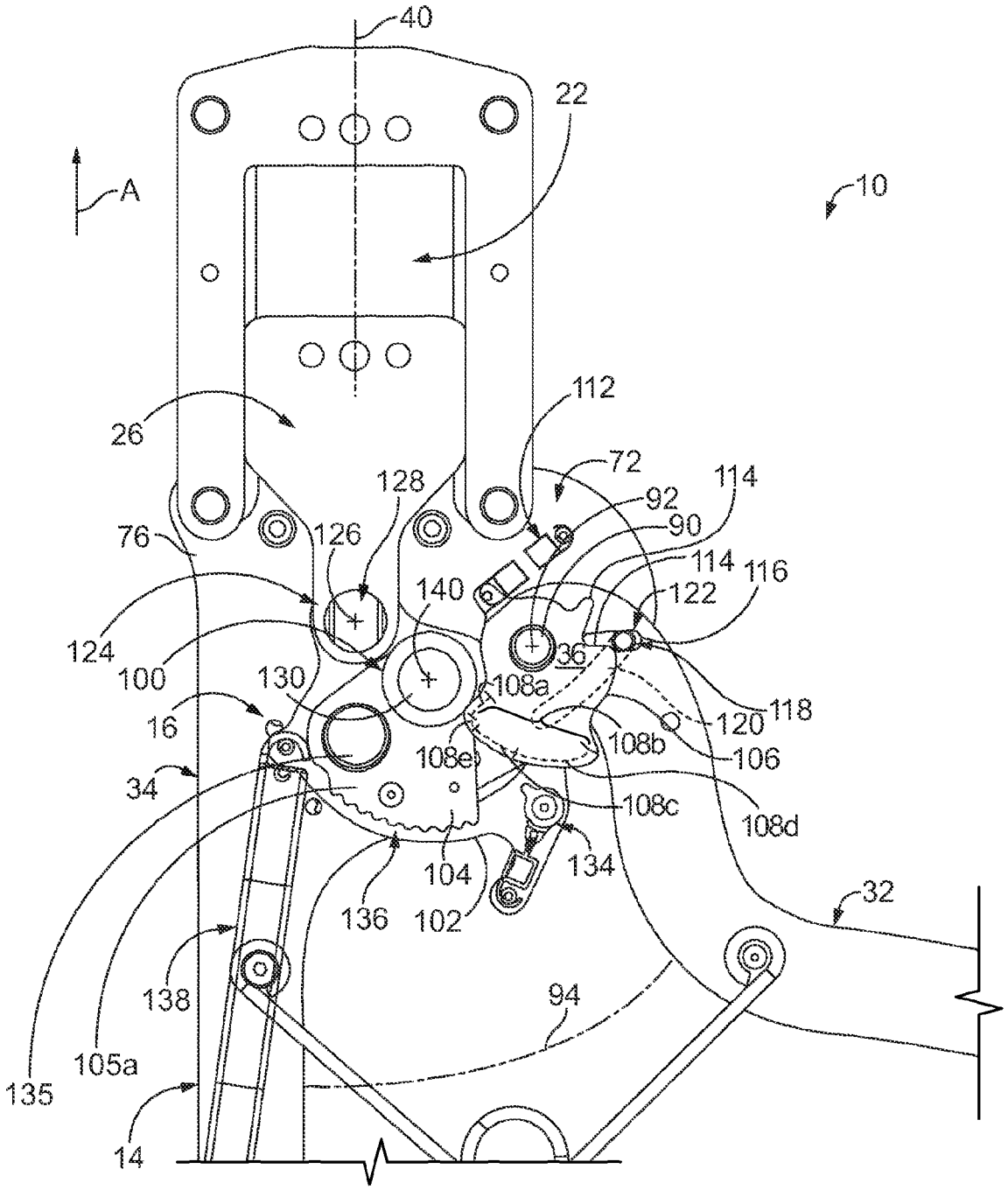
FIG. 3 is a side view of a portion of the crimp tool shown in FIGS. 1 and 2.

FIG. 3 is a side view of a portion of the crimp tool 10. One of the frame members 76 has been removed from the tool 10 in FIG. 3 to illustrate the toggle mechanism 16. The toggle mechanism 16 includes the cam 36, a cam follower 100, an upper link 102, and a lower link 104. The cam 36 is rotatably mounted on the frame 72 such that the cam 36 rotates relative to the frame 72. In the exemplary embodiment, the cam 36 is mounted to the frame 72 using the pivot bearing 90 such that the cam 36 rotates about the axis of rotation 92. As will be described below, the cam 36 is configured to rotate about the axis of rotation 92 in both clockwise and counter-clockwise directions during operation of the tool 10.

The cam 36 includes a cam surface 106 that engages the cam follower 100 during operation of the crimp tool 10. The cam surface 106 is the radially outermost surface of the cam 36 relative to the axis of rotation 92. The cam surface 106 defines a circumference, or periphery, of the cam 36. The cam surface 106 has a variable distance from the axis of rotation 92 along the circumference of the cam 36. In other words, the radius of the cam 36 is different at different locations along the circumference, or periphery, of the cam 36. The shape, or path, of the surface 106 along the circumference or periphery of the cam 36 will be referred to herein as a "profile". The variable profile of the cam 36 provides a variable mechanical advantage between the handle 14 and the crimp jaw 22 along the range of motion of the lever 32 relative to the arm 34 of the handle 14.

FIG. 3 illustrates the cam 36 in a rotational position that corresponds to the beginning of a crimping cycle when the lever 32 is in the open position. The exemplary cam surface 106 of the cam 36 includes a plurality of different segments 108 that each has a different profile. For example, the cam 36 includes a fully open segment 108*a* that engages the cam follower 100 at the beginning of a crimping cycle when the lever 32 is in the open position relative to the arm 34. The cam 36 also includes a crimping segment 108*b* that engages the cam follower 100 during the crimping cycle, or more specifically during movement of the jaw member 26 along the crimp axis 40. The crimping segment 108*b* includes a plurality of sub-segments 108*c*, 108*d*, and 108*e* that engage the cam follower 100 during different portions of the crimping cycle. The sub-segment 108*c* of the cam 36 engages the cam follower 100 during a first pump of the lever 32 from the open position to the closed position relative to the arm 34, while the sub-segment 108*d* engages the cam follower during a second pump of the lever 32 from the open position to the closed position. The sub-segment 108*c* includes the sub-segment 108*e*, which engages the cam follower 100 during a rapid advance portion of the crimping cycle.

Optionally, the cam 36 is connected to the frame 72 via a biasing element 112 that for biasing the cam 36 in a rotation direction during the operation of the crimp tool 10. In the exemplary embodiment, the biasing element 112 biases the cam 36 to the orientation shown in FIG. 8. Optionally, the cam 36 can be disengaged from the lever 32 during a portion of the crimping cycle. By "disengaged", it is meant that the cam 36 is not rotatably connected to the lever 32 for rotation therewith. In other words, when the cam 36 and lever 32 are disengaged, the cam 36 does not rotate along with the lever 32 as the lever 32 is rotated, and vice versa. On the other hand, when the cam 36 and lever 32 are engaged, rotation of the lever 32 will drive rotation of the cam 36. In the exemplary embodiment, the cam 36 includes a plurality of ratchet teeth 114 and the lever 32 includes a slot 116 and a cam drive pin 118. The cam drive pin 118 slides to different positions within the slot 116 wherein the pin 118 is engaged or disengaged with one of the ratchet teeth 114 of the cam 36. When the cam drive pin 118 is engaged with one of the ratchet teeth 114, the cam 36 is engaged with the lever 32. When the cam drive pin 118 is disengaged from the ratchet teeth 114, the cam 36 and lever 32 are disengaged. The frame 72 of the handle 14 optionally includes a slot 120 within which the cam drive pin 118 extends. As will be apparent from the discussion of FIGS. 5-9, the slot 120 provides a guide for movement of the cam drive pin 118 within the slot 116 of the lever 32. An end 122 of the slot 120 may act as a stop to prevent the lever 32 from rotating in a counter-clockwise direction past the open position shown in FIGS. 1, 3, 5, and 8. In the exemplary embodiment, the cam 36 includes two ratchet teeth 114. But, the cam 36 may include any number of ratchet teeth 114, which may or may not depend on a number of pumps of the lever 32 that is required to complete a crimping cycle.

Figure 4:
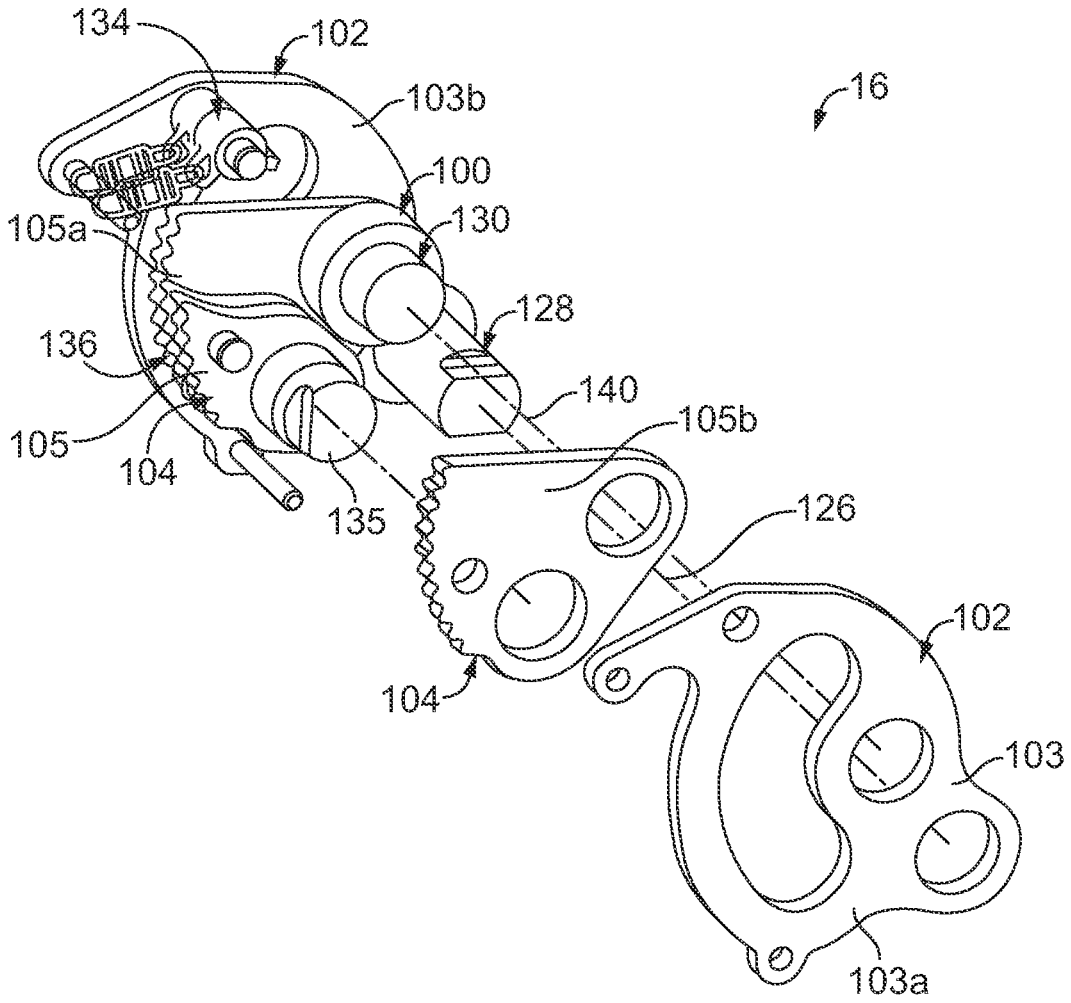
FIG. 4 is an exploded perspective view of an exemplary embodiment of a portion of a toggle mechanism of the crimp tool shown in FIGS. 1-3.

FIG. 4 is an exploded perspective view of an exemplary embodiment of a portion of the toggle mechanism 16. FIG. 4 illustrates the upper link 102, the lower link 104, and the cam follower 100. The cam 36 (FIGS. 1, 3, and 5-9) is not shown in FIG. 4. In the exemplary embodiment, the upper link 102 is defined by two upper link members 103, namely the upper link members 103*a* and 103*b*. However, the upper link 102 may be defined by any number of upper link members 103. It should be apparent from FIG. 4 that the upper link member 103*b* has been removed from FIGS. 3 and 5-9 to clearly illustrate the remainder of the toggle mechanism 16.

Referring now to FIGS. 3 and 4, the upper link 102 connects the cam follower 100 to the jaw member 26 (not shown in FIG. 4). In other words, the upper link 102 provides a link between the cam follower 100 and the jaw member 26. Specifically, the cam follower 100 is mounted on the upper link 102 and the upper link 102 is pivotally connected to an end 124 (not shown in FIG. 4) of the jaw member 26 such that the upper link 102 and the jaw member 26 can pivot relative to each other about a pivot axis 126. In the exemplary embodiment, the upper link 102 is pivotally connected to the jaw member 26 using a pivot bearing 128, and the cam follower 100 is mounted on a pivot bearing 130 that, as will be described below, enables the lower link 104 to pivot relative to the upper link 102.

The upper link 102 includes an optional spring-loaded ratchet pawl 134. As will be described below, the ratchet pawl 134 engages ratchet teeth 136 of the lower link 104 to enable the lever 32 (not shown in FIG. 4) to ratchet during a crimping cycle. Engagement between the ratchet pawl 134 and the ratchet teeth 136 may prevent a partially crimped workpiece from being removed from the crimp tool 10. Optionally, the upper link 102 is connected to the frame 72 (not shown in FIG. 4) via a biasing element 138 (not shown in FIG. 4) for biasing the upper link 102 to the position shown in FIGS. 3 and 5 that corresponds to the beginning of a crimping cycle when the lever 32 is in the open position relative to the arm 34 (not shown in FIG. 4). The biasing element 138 biases the upper link 102 at the end of a crimp cycle to return the upper link 102 to the beginning position shown in FIGS. 3 and 5.

In the exemplary embodiment, the lower link 104 is defined by two lower link members 105, namely the lower link members 105*a* and 105*b* (not visible in FIG. 3). However, the lower link 104 may be defined by any number of lower link members 105. It should be apparent from FIG. 4 that the lower link 104 is sandwiched between the upper link members 103*a* and 103*b* of the upper link 102. As described above, the lower link 104 is pivotable relative to the upper link 102. Specifically, the lower link 104 is pivotally connected to the upper link 102 using the pivot bearing 130 such that the lower link 104 can pivot relative to the upper link 102 about a pivot axis 140. The lower link 104 is also pivotable about a stationary pin 135 that is mounted to the frame members 76 (not shown in FIG. 4) of the frame 72 (not shown in FIG. 4). The lower link 104 includes the ratchet teeth 136 that are engaged by the ratchet pawl 134 of the upper link 102 during a crimping cycle.

In the exemplary embodiment, the pivot bearing 128 is a solid rod that extends through holes within the jaw member 26 and the upper link 102 to interconnect the jaw member 26 to the upper link 102. In addition or alternative to the pivot bearing 128 and/or the holes of the jaw member 26 and/or the upper link 102, the jaw member 26 may be pivotally connected to the upper link 102 using any other structure, means, arrangement, configuration, type of bearing, and/or the like, such as, but not limited to, a flexural bearing, a roller bearing, a ball bearing, and/or the like. Similarly, the pivot bearing 130 is a solid rod that extends through holes within the lower link 104 and the upper link 102 to interconnect the lower link 104 to the upper link 102. In addition or alternative to the pivot bearing 130 and/or the holes of the upper link 102 and/or the lower link 104, the lower link 104 may be pivotally connected to the upper link 102 using any other structure, means, arrangement, configuration, type of bearing, and/or the like. For example, the lower link 104 may be pivotally connected to the upper link 102 using a flexural bearing, a roller bearing, a ball bearing, and/or the like.

Referring again to FIG. 3, the general operation of the toggle mechanism 16, to move the jaw member 26 along the crimp axis 40 toward the jaw member 24, will now be described. As can be seen in FIG. 3, the cam surface 106 of the cam 36 engages the cam follower 100. As the lever 32 is rotated along the arc 94 toward the arm 34, the cam 36 rotates about the axis of rotation 92 in the clockwise direction. The cam surface 106 of the cam 36 exerts a force on the cam follower 100 that moves the cam follower 100 in an arc about the stationary pin 135. As the cam follower 100 moves, the upper link 102 moves the pivot bearing 128, and thus the jaw member 26, along the crimp axis 40 in the direction of the arrow A. As best seen in FIGS. 1 and 2, the frame 72 of the handle 14 optionally includes a slot 142 that receives the pivot bearing 128 of the jaw member 26 for guiding movement of the jaw member 26 along the crimp axis 40.

The variable profile of the cam surface 106 exerts a variable force on the cam follower 100 along the range of motion of the lever 32 relative to the arm 34 of the handle 14. The variable profile of the cam surface 106 provides a variable mechanical advantage between the handle 14 and the crimp jaw 22 along the range of motion of the lever 32 relative to the arm 34 of the handle 14. The profile of the cam surface 106 overall as well as the profile of the various segments thereof can be selected to provide a predetermined handle force input curve. The handle force input curve represents the force (referred to herein as the "handle force") at various points along the range of motion of the lever 32 that is required to be exerted on the lever 32 to move the lever 32 toward the arm 34. The handle force input curve includes a peak handle force that represents the force required to be exerted on the lever 32 to complete the crimp of a workpiece. The profile of the cam surface 106 overall as well as the profile of various segments thereof can be selected to provide a predetermined peak handle force. Moreover, the profile of the cam surface 106 overall as well as the profile of various segments thereof can be selected to provide a crimp tool that requires more than one pump of the lever 32 to complete a crimp. Increasing the number of pumps required to complete a crimp may reduce a peak handle force of the tool that is required to complete the crimp.

Figure 5:
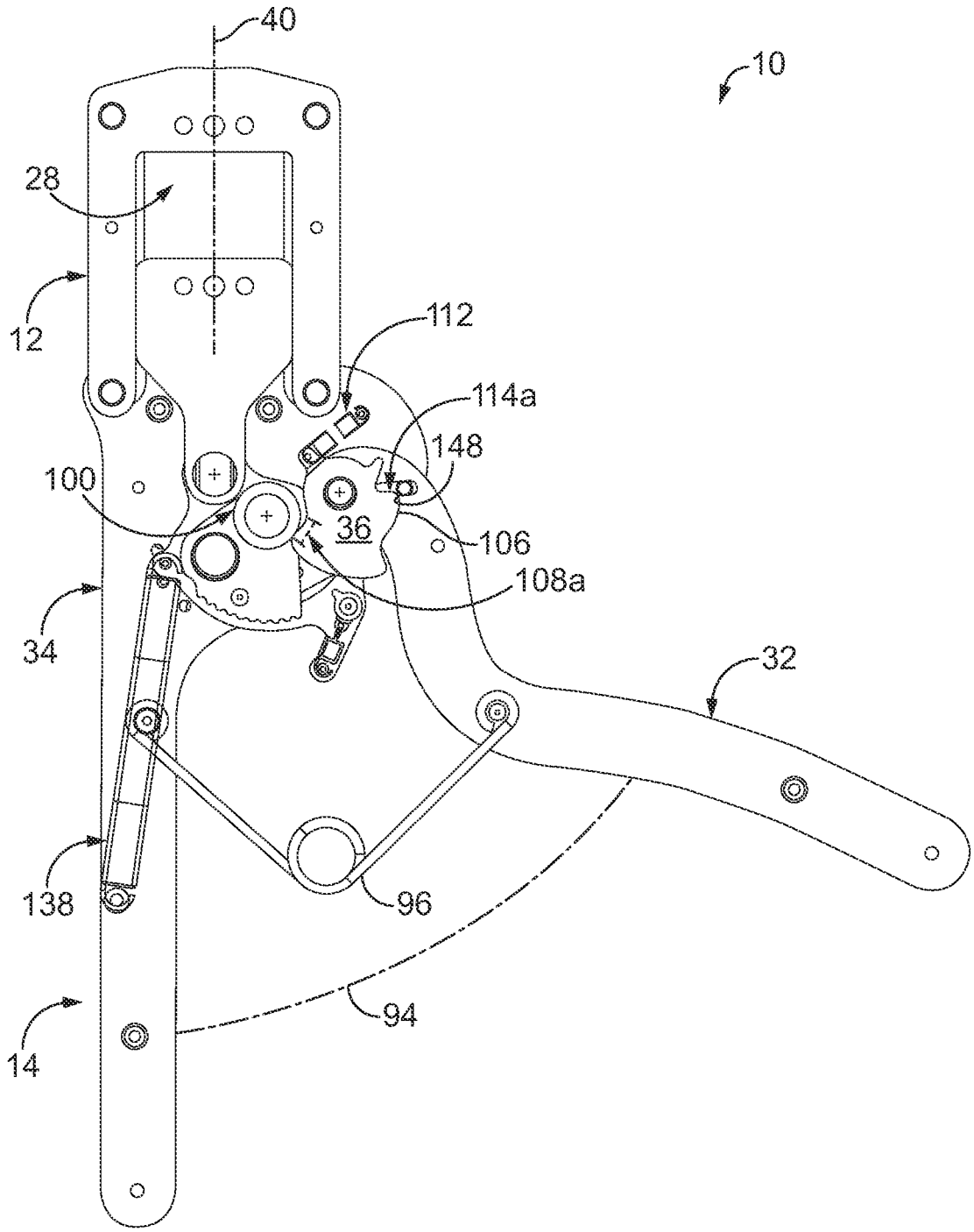
FIGS. 5-9 are side views of the crimp tool shown in FIGS. 1-3 illustrating operation of the crimp tool.
Figure 6:
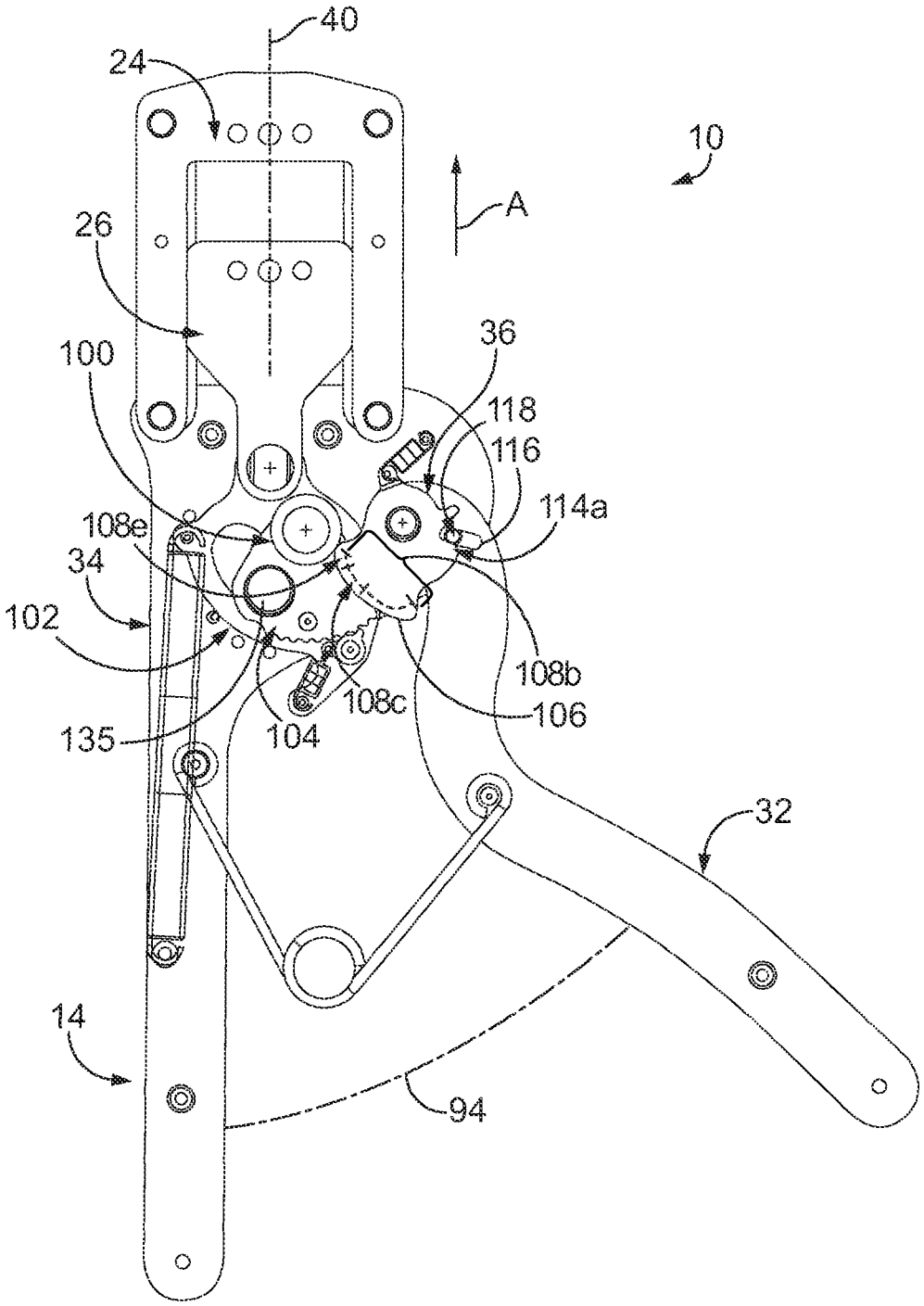

Referring now to FIGS. 5-9, operation of the crimp tool 10 will now be described. The crimp tool 10 is shown in FIG. 5 at the beginning of a crimping cycle wherein the lever 32 of the handle 14 is in the open position and the fully open segment 108*a* of the cam surface 106 is engaged with the cam follower 100. To begin a crimp, one or more workpieces is positioned within the opening 28 of the crimp head 12 such that the workpiece(s) is positioned within the crimping zone. The handle 14 of the crimp tool 10 is grasped with one or both of a user's hands. Referring now to FIG. 6, the user then squeezes the handle 14 to move the lever 32 along the arc 94 toward the arm 34 and thereby begin the first pump stage of the crimping cycle. As the lever 32 begins to moves toward the arm 34, the cam drive pin 118 moves within the slot 116 of the lever 32 into engagement with a first-pump ratchet tooth 114*a* of the cam 36 to engage the cam 36 with the lever 32. As the lever 32 moves, the crimping segment 108*b* of the cam surface 106 engages the cam follower 100. Specifically, the first pump sub-segment 108*c* of the cam surface 106 engages the cam follower 100, beginning with the rapid-advance sub-segment 108*e*. The cam surface 106 exerts a force on the cam follower 100 that moves the cam follower 100 in an arc about the stationary pin 135. As the cam follower 100 moves to the position shown in FIG. 6, the links 102 and 104 are moved such that the jaw member 26 moves along the crimp axis 40 toward the jaw member 24, as indicated by the arrow A. As should be apparent from FIGS. 5 and 6, the lower link 104 has pivoted relative to the upper link 102.

The movement of the lever 32 between the positions shown in FIGS. 5 and 6 represents a rapid advance stage of the crimping cycle, which is a sub-stage of the first pump stage. The profile of the rapid advance sub-segment 108*e* of the cam surface 106 is selected to provide the jaw member 26 with a greater amount of travel, but a lower amount of crimping force and handle force, relative to other stages of the crimping cycle. In other words, the same amount of travel of the lever 32 causes the jaw member 26 to travel a greater distance along the crimp axis 40 during the rapid advance stage than during other stages of the crimping cycle. During the rapid advance stage, the crimp jaw 22 grips the workpiece. When the workpiece is an electrical terminal, the crimp jaw 22 grips the terminal during the rapid advance stage to thereby free a user's hand for inserting an electrical conductor into the terminal. Optionally, a shoulder 148 of the of the first pump ratchet tooth 114*a* of the cam 36 may have a shape that causes the cam 36 to rotate a greater amount than the lever 32 during the rapid advance stage, which may minimize rotation of the lever 32 during the rapid advance stage. Minimizing the rotation of the lever 32 during the rapid advance stage may increase an available amount of travel of the lever 32 along the arc 94 during the first pump stage, which may enable the crimping force to be spread out over a greater distance resulting in a lower peak handle force.

Referring now to FIG. 7, the lever 32 is moved further along the arc 94 into the closed position of the lever 32 relative to the arm 34 to complete the first pump of the crimp. Engagement of the first pump crimping sub-segment 108*c* of the cam surface 106 and the cam follower 100 moves the cam follower 100 further along the arc about the stationary pin 135. Such movement causes the upper link 102 to move the jaw member 26 further along the crimp axis 40 toward the jaw member 24 in the direction of the arrow A. As can be seen in FIG. 7, the lower link 104 has pivoted further relative to the upper link 102. The ratchet pawl 134 of the upper link 102 is engaged with the ratchet teeth 136 of the lower link 104.

Once the first pump of the lever 32 toward the arm 34 of the handle 14 is complete as shown in FIG. 7, the user releases the lever 32. The bias of the spring 96 forces the lever 32 to return to open position of the lever 32 relative to the arm 34 as shown in FIG. 8. The ratchet pawl 134 of the upper link 102 is engaged with the ratchet teeth 136 of the lower link 104 to hold the upper link 102, the lower link 104, the cam follower 100, and the jaw member 26 in the position shown in FIGS. 7 and 8 while the lever 32 returns to the open position. As the lever 32 is released by the user, the cam drive pin 118 is forced past a back-side 144 of a second-pump ratchet tooth 114*b* of the cam 36 to slide within the slot 116 of the lever 32 away from the cam 36 and thereby rotationally disengage the cam 36 from the lever 32. Once disengaged from the lever 32, the bias of the biasing element 112 rotates the cam 36 from the position shown in FIG. 7 to the position shown in FIG. 8.

After the lever 32 has returned to the open position shown in FIG. 8, the second pump of the crimping cycle is begun. Specifically, the handle 14 of the crimp tool 10 is grasped with one or both of a user's hands. The user then squeezes the handle 14 to move the lever 32 along the arc 94 toward the arm 34 and thereby begin the second pump stage of the crimping cycle. As the lever 32 begins to move toward the arm 34, the cam drive pin 118 moves within the slot 116 of the lever 32 into engagement with a front side 146 of the second-pump ratchet tooth 114*b* of the cam 36 to engage the cam 36 with the lever 32. As the lever 32 moves, the second pump sub-segment 108*d* of the crimping segment 108*b* of the cam surface 106 engages the cam follower 100. The cam surface 106 exerts a force on the cam follower 100 that moves the cam follower 100 further along the arc about the stationary pin 135. As the cam follower 100 moves to the position shown in FIG. 9, the links 102 and 104 are moved such that the jaw member 26 moves along the crimp axis 40 toward the jaw member 24 into the position shown in FIG. 9. The movement of the lever 32 between the positions shown in FIGS. 6-9 represents the crimping of the workpiece(s). In other words, the workpiece(s) is crimped by the crimp jaw 22 during the engagement between the first and second pump sub-segment 108*c* and 108*d*, respectively, of the cam surface 106 and the cam follower 100.

During the crimping cycle, and more specifically during the first and second pump stages, the crimping force exerted by the crimp jaw 22 on the workpiece builds to a predetermined peak crimping force. Because the mechanical advantage of the toggle mechanism 16 increases during the first and second pump stages, the load exerted on the cam 36 by the cam follower 100 (referred to herein as the "cam follower reaction") peaks before the crimping force reaches the peak crimping force. The handle force builds to a peak during the first pump stage of the crimping cycle and remains approximately at the peak until the end of the second pump stage of the crimping cycle. The profiles of the first and second-pump sub-segments 108*c* and 108*d*, respectively, of the cam surface 106 may be selected to lower and/or minimize the peak handle force. For example, the crimp tool 10 may do more work during the beginning and end of a crimping cycle, or more specifically during a beginning of the first pump stage and an end of the second pump stage, which may result in a lower peak handle force.

Once the crimp of the workpiece(s) is complete, the user releases the lever 32. The bias of the spring 96 forces the lever 32 to return to open position of the lever 32 relative to the arm 34 as shown in FIG. 5. As the lever 32 is released, the bias of the biasing element 138 pulls the upper and lower links 102 and 104, respectively, to the beginning position shown in FIG. 5. The return of the links 102 and 104 to the beginning position shown in FIG. 5 causes the cam 36 to rotate in the counter-clockwise direction to return the cam 36 to the beginning position shown in FIG. 5. In the position shown in FIG. 5, the cam drive pin 118 may engage the shoulder 148 of the first pump ratchet tooth 114*a* of the cam 36 to prevent the cam 36 from rotating in the counter-clockwise direction past the position shown in FIG. 5.

Figure 10:
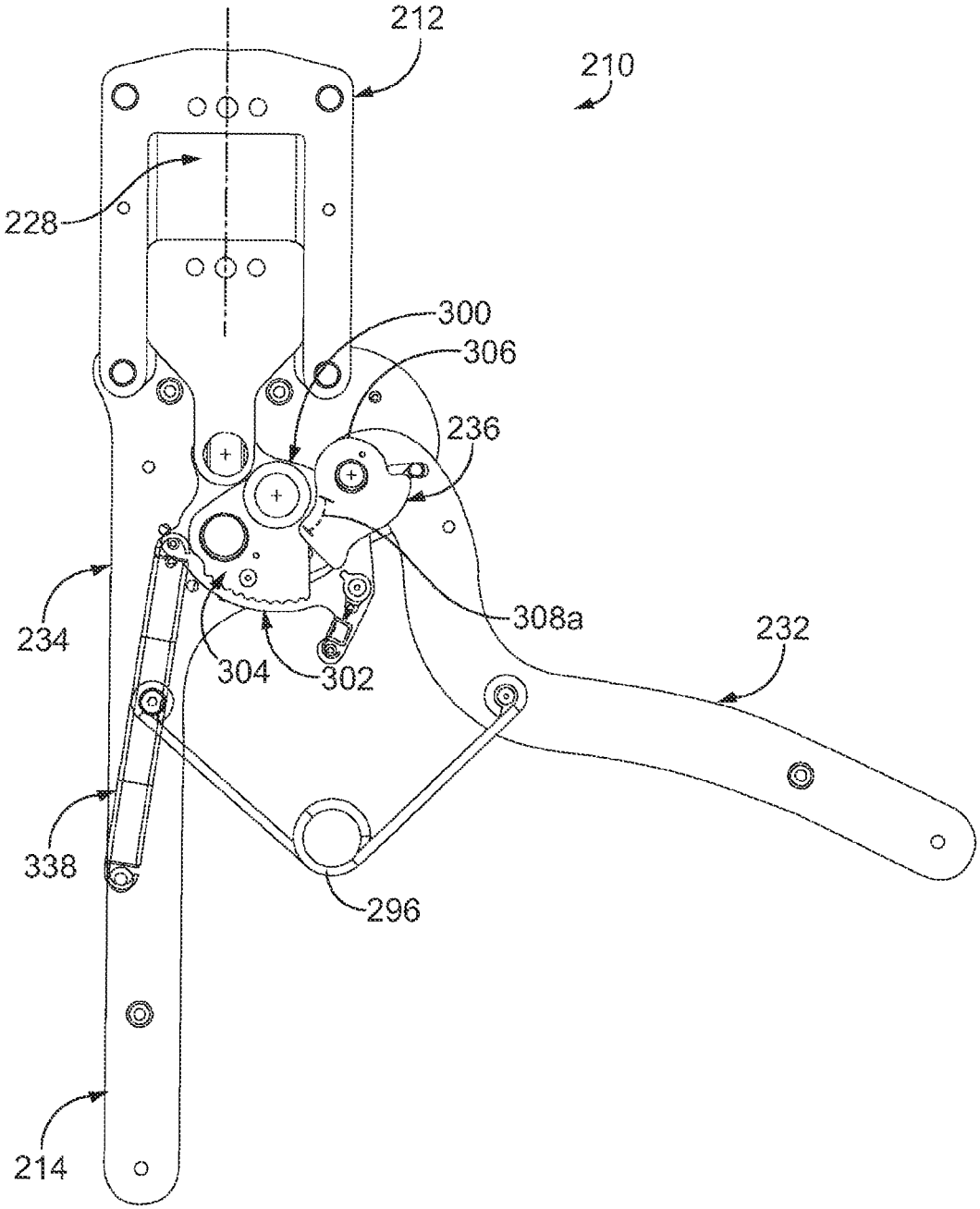
FIGS. 10-12 are side views of an exemplary alternative embodiment of a crimp tool illustrating operation of the crimp tool.
Figure 11:
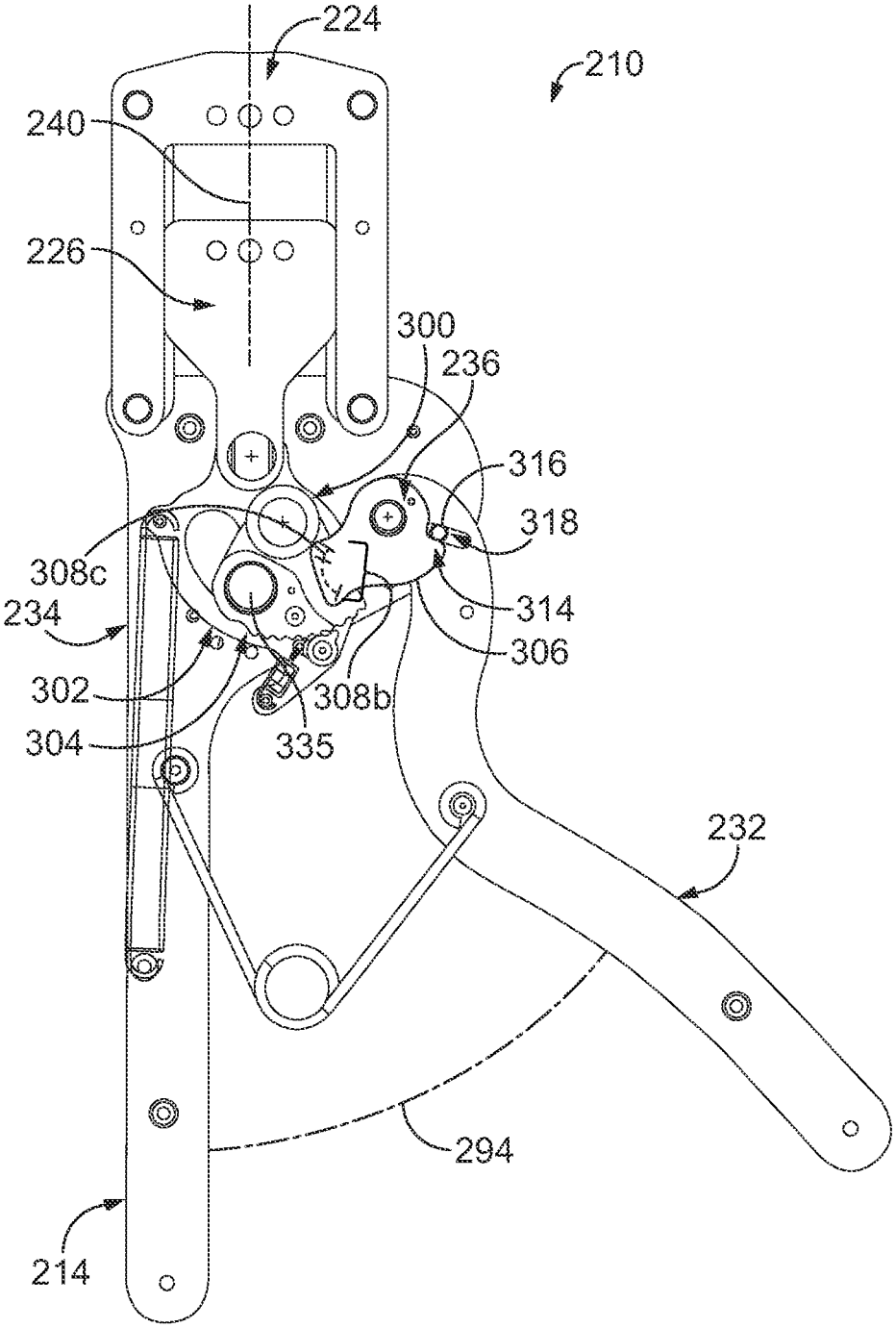
Figure 12:
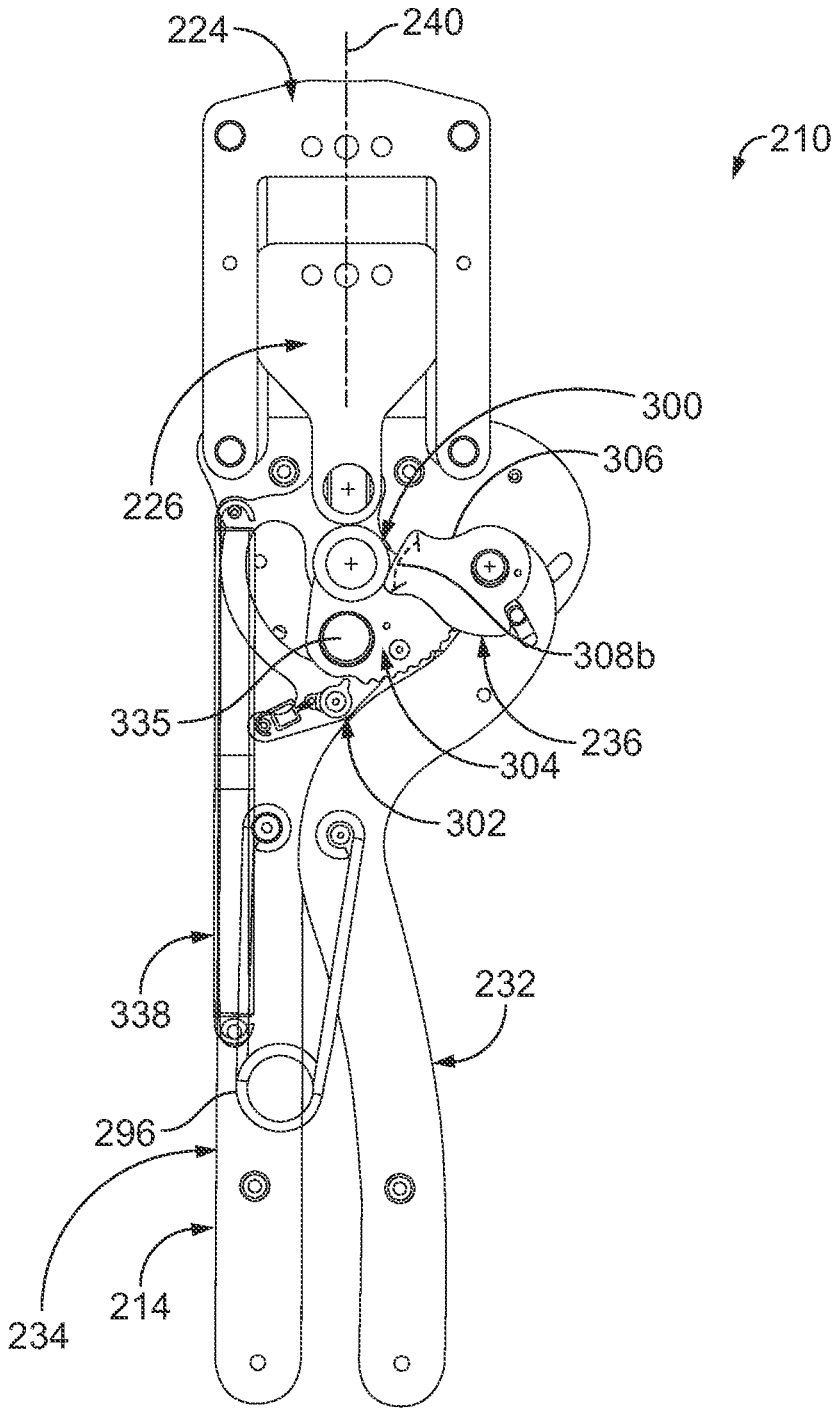

Although the crimp tool 10 utilizes two pumps of the lever 32 relative to the arm 34 of the handle 14, the subject matter described and/or illustrated herein may be incorporated into a crimp tool that uses any number of pumps greater or lesser than two pumps. For example, FIGS. 10-12 illustrate an exemplary alternative embodiment of a crimp tool 210. The crimp tool 210 is similar to the crimp tool 10 except the crimp tool 210 is configured to crimp one or more workpieces using only a single pump of a lever 232 relative to an arm 234 of a handle 214 of the crimp tool 210.

Referring to FIG. 10, operation of the crimp tool 210 will now be described. The crimp tool 210 is shown in FIG. 10 at the beginning of a crimping cycle wherein the lever 232 of the handle 214 is in the open position and a fully open segment 308*a* of a cam surface 306 of the cam 236 is engaged with a cam follower 300. To begin a crimp, one or more workpieces is positioned within an opening 228 of a crimp head 212 of the tool 210 such that the workpiece(s) is positioned within the crimping zone of the tool 210. The handle 214 of the crimp tool 210 is grasped with one or both of a user's hands. Referring now to FIG. 11, the user then squeezes the handle 214 to move the lever 232 along an arc 294 toward the arm 234 and thereby begin the crimping cycle. As the lever 232 begins to move toward the arm 234, a cam drive pin 318 moves within a slot 316 of the lever 232 into engagement with a ratchet tooth 314 of the cam 236 to rotationally engage the cam 236 with the lever 232. As the lever 232 moves, a crimping segment 308*b* of the cam surface 306 engages the cam follower 300. Specifically, a rapid-advance sub-segment 308*c* of the crimping segment 308*b* engages the cam follower 300. The cam surface 306 exerts a force on the cam follower 300 that moves the cam follower 300 in an arc about a stationary pin 335. As the cam follower 300 moves to the position shown in FIG. 11, the upper link 302 and a lower 304 are moved such that a jaw member 226 of a crimp jaw 222 of the crimp tool 210 moves along a crimp axis 240 toward another jaw member 224 of the crimp jaw 222. The movement of the lever 232 between the positions shown in FIGS. 10 and 11 represents a rapid advance stage of the crimping cycle.

Referring now to FIG. 12, the lever 232 is moved further along the arc 294 into a closed position of the lever 232 relative to the arm 234 to complete the crimp. As the lever 232 moves, the cam surface 306 exerts a force on the cam follower 300 that moves the cam follower 300 further in the arc about the stationary pin 335. As the cam follower 300 moves to the position shown in FIG. 12, the links 302 and 304 are moved such that the jaw member 226 moves along the crimp axis 240 toward the jaw member 224 into the position shown in FIG. 12. The movement of the lever 232 between the positions shown in FIGS. 11 and 12 represents the crimping of the workpiece(s) The profile of the crimping segment 308*b* of the cam surface 106 may be selected to lower and/or minimize the peak handle force.

Once the crimp of the workpiece(s) is complete, the user releases the lever 232. The bias of a spring 296 forces the lever 232 to return to open position of the lever 232 relative to the arm 234 as shown in FIG. 10. As the lever 232 is released, the bias of a biasing element 338 pulls the upper and lower links 302 and 304, respectively, to the beginning position shown in FIG. 10. The return of the links 302 and 304 to the position shown in FIG. 10 causes the cam 236 to rotate in the counter-clockwise direction to return the cam 236 to the beginning position shown in FIG. 10.

Although shown as being separate and discrete components, the cam 236 and the lever 232 may alternatively be integrally formed as a single component.

The embodiments described and/or illustrated herein provide a crimp tool that may have a lower peak handle force than at least some known crimp tools while maintaining or reducing the length of the arms and/or lever of a handle of the crimp tool. The embodiments described and/or illustrated herein provide a crimp tool that may be operated using any number of pumps. The embodiments described and/or illustrated herein may provide a crimp tool that may be operated using only a single hand of the user.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Similarly, the terms "front", "rear", "top", "bottom", and "side" etc. in the claims are used merely as labels, and are not intended to impose orientational requirements on their objects. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the description and illustrations. The scope of the subject matter described and/or illustrated herein should therefore be determined with reference to the appended claims, along with the full scope of equivalents to which such claims are entitled. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. A crimp tool for crimping a workpiece, said crimp tool comprising:

a crimp head comprising a crimp jaw, the crimp jaw having opposing jaw members, at least one of the jaw members being movable toward and away from the other jaw member for crimping an object therebetween;

a handle mounted to the crimp head, the handle comprising a frame and a lever rotatably mounted on the frame for rotation relative to the frame between an open position and a closed position, the lever defining a slot, the handle further comprising a cam drive pin being slidable within the slot, rotation of the lever causing the cam drive pin to slide within the slot between an engaged position and a disengaged position; and a toggle mechanism operatively connected between the lever of the handle and the at least one jaw member of the crimp head, the toggle mechanism comprising a cam and a cam follower engaging a periphery of the cam, the cam including a ratchet tooth along the periphery of the cam, the cam drive pin in the engaged position engaging the ratchet tooth to rotatably couple the lever to the cam such that the cam is rotated in a first rotational direction by the lever as the lever rotates from the open position to the closed position, rotation of the cam causing translation of the cam follower to cause movement of the at least one jaw member towards the other jaw member, the cam being configured to rotate in an opposite, second rotational direction relative to the frame as the lever rotates from the closed position to the open position.

2. The crimp tool according to claim 1, wherein the toggle mechanism further comprises an upper link and a lower link, wherein the upper link pivotably connects the cam follower to the at least one jaw member, and wherein the lower link pivotably connects the cam follower to a stationary pin that is mounted to the frame.

3. The crimp tool according to claim 1, wherein the cam drive pin in the disengaged position disengages the ratchet tooth to enable rotation of the lever relative to the cam, and rotation of the cam relative to the lever, as the lever rotates from the closed position to the open position.

4. The crimp tool according to claim 1, wherein the periphery of the cam has a fully open segment configured to engage the cam follower when the lever is in the open position, the periphery of the cam has a crimping segment configured to engage the cam follower during movement of the at least one jaw member, wherein a profile of the fully open segment is different than a profile of the crimping segment.

5. The crimp tool according to claim 1, wherein the periphery of the cam has a first pump segment engaging the cam follower during a first pump of the lever from the open position to the closed position during a crimping operation, the periphery of the cam has a different, second pump segment engaging the cam follower during a second pump of the lever from the open position to the closed position during the crimping operation, wherein the cam rotates relative to the cam follower between the first and second pumps of the lever such that the second pump segment of the cam includes a portion of the first pump segment.

6. A crimp tool for crimping a workpiece, said crimp tool comprising:

a crimp head comprising a crimp jaw, the crimp jaw having opposing upper and lower jaw members arranged along a crimp axis, the lower jaw member being movable along the crimp axis relative to the upper jaw member;

a handle mounted to the crimp head, the handle comprising a frame and a lever rotatably mounted on the frame for rotation relative to the frame between an open position and a closed position, the lever defining a slot, the handle further comprising a cam drive pin being slidable within the slot, rotation of the lever causing the cam drive pin to slide within the slot between an engaged position and a disengaged position; and a toggle mechanism below the crimp head operatively connected between the lever of the handle and the lower jaw member of the crimp head, the toggle mechanism comprising a cam and a cam follower engaging a periphery of the cam, the cam including a ratchet tooth along the periphery of the cam, the cam drive pin in the engaged position in the slot engaging the ratchet tooth to rotatably couple the lever to the cam such that the cam is rotated by the lever as the lever rotates from the open position to the closed position, rotation of the cam causing translation of the cam follower to drive movement of the lower jaw member upwards along the crimp axis towards the upper jaw member as the lever is rotated to the closed position, the cam follower moving relative to the lever.

7. The crimp tool of claim 6, wherein the lever of the handle is configured to be pumped at least twice from the open position to the closed position during a single crimping operation.

8. The crimp tool of claim 6, wherein the cam drive pin in the disengaged position in the slot disengages the ratchet tooth to enable rotation of the lever relative to the cam, and rotation of the cam relative to the lever, as the lever rotates from the closed position to the open position.

9. The crimp tool of claim 6, wherein the toggle mechanism further comprises an upper link and a lower link, the upper link connects the cam follower to the lower jaw member, the lower link pivotably connects the cam follower to a stationary pin that is mounted to the frame, the lower link including multiple ratchet teeth, at least one of the ratchet teeth of the lower link engaged by a ratchet pawl on the upper link after a first pump of the lever from the open position to the closed position during a crimping operation to hold the lower link and cam follower in place as the lever rotates towards the open position, wherein, as the lever rotates towards the open position, the cam rotates, independently of the lever, to a second-pump starting position prior to a second pump of the lever from the open position to the closed position during the crimping operation.

10. The crimp tool of claim 1, wherein the ratchet tooth of the cam has a shape that causes the cam to rotate a greater angular amount than the lever as the cam drive pin of the lever engages the ratchet tooth and the lever rotates from the open position to the closed position.

11. The crimp tool of claim 6, wherein the cam is directly coupled to a biasing member and, as the lever rotates from the closed position towards the open position, the lever rotates relative to the cam, and the biasing member causes the cam to rotate relative to the lever and the cam follower.

* * * * *